US007389662B2

(12) United States Patent
Roberts et al.

(10) Patent No.: US 7,389,662 B2
(45) Date of Patent: Jun. 24, 2008

(54) METHOD AND APPARATUS FOR SELF INDEXING PORTABLE AUTOMATED TENON PEENING

(75) Inventors: Dennis William Roberts, Schenectady, NY (US); John Francis Nolan, Cobleskill, NY (US); Andrew John Tomko, Glenville, NY (US); John Matthew Sassatelli, Valley Falls, NY (US); Benedict Kazirskis, Acworth, GA (US)

(73) Assignee: General Electric Company, Schenectady, NY (US)

( * ) Notice: Subject to any disclaimer, the term of this patent is extended or adjusted under 35 U.S.C. 154(b) by 376 days.

(21) Appl. No.: 11/240,247

(22) Filed: Sep. 30, 2005

(65) Prior Publication Data

US 2007/0074554 A1 Apr. 5, 2007

(51) Int. Cl.

| | |
|---|---|
| ***B21S 15/02*** | (2006.01) |
| ***B24B 1/00*** | (2006.01) |
| *B21J 1/00* | (2006.01) |

(52) U.S. Cl. ..... 72/53; 29/889.21; 29/90.7; 451/39

(58) Field of Classification Search ..... 29/243.54, 29/889.21, 90.7, 889.22, 505, 889.7; 72/53, 72/430, 707, 453.19; 451/36, 38, 39
See application file for complete search history.

(56) References Cited

U.S. PATENT DOCUMENTS

| | | | | |
|---|---|---|---|---|
| 4,437,213 | A * | 3/1984 | Reese et al. | 29/243.54 |
| 5,060,375 | A * | 10/1991 | Demichel | 29/889.21 |
| 6,271,495 | B1 | 8/2001 | Rooney | |
| 6,336,844 | B1 * | 1/2002 | Duquenne et al. | 451/36 |
| 6,526,657 | B2 | 3/2003 | Fischer et al. | |
| 6,606,892 | B2 | 8/2003 | Fischer et al. | |
| 2002/0081204 | A1 * | 6/2002 | Burnett et al. | 29/889.21 |

* cited by examiner

*Primary Examiner*—David B Jones
(74) *Attorney, Agent, or Firm*—Cantor Colburn LLP

(57) ABSTRACT

A self indexing portable automated tenon peening device including: a peening machine in operable communication with a mounting arm; a circumferential slide assembly including a circumferential rail in operable communication with the mounting arm; an axial slide assembly including a axial slide rail in operable communication with the circumferential slide assembly; a base in operable communication with the axial slide assembly; and a programmable logic controller for controlling a position of the circumferential slide assembly and the axial slide assembly.

15 Claims, 4 Drawing Sheets

METHOD AND APPARATUS FOR SELF INDEXING PORTABLE AUTOMATED TENON PEENING

BACKGROUND

The present disclosure relates to a portable automated peening apparatus for automatically peening steam turbine bucket tenons and a method for automated peening steam turbine bucket tenons.

In the construction of turbines, for example, steam turbines, cover plates are employed for a variety of reasons and are generally secured to the tips of the turbine buckets by peening tenons formed on the buckets or the cover plates. As used herein the term peen refers to the end of a hammerhead such as a spherical or flat striking surface, often wedge-shaped or ball-shaped and used for chipping, indenting. Radial peening is oftentimes used in certain bucket constructions. Not only is the riveting operation loud but there is substantial variation from tenon to tenon based on operator action. It should be appreciated that the terms peening and riveting are interchangeably used herein. While certain automated peening tools, including reciprocating, orbital and radial tools are available; no currently available portable automated peening apparatus automatically peens a tenon as well as a tenon peened by a manual operation. Accordingly, it is desirable to provide a portable automated machine and methods for peening tenons for securing cover plates and adjacent bucket tips of a turbine wheel to one another.

BRIEF DESCRIPTION

Disclosed herein is a portable automated tenon peening device including: a peening machine in operable communication with a mounting arm; a circumferential slide assembly including a circumferential rail in operable communication with the mounting arm; an axial slide assembly including a axial slide rail in operable communication with the circumferential slide assembly; a base in operable communication with the axial slide assembly; and a programmable logic controller for controlling a position of the circumferential slide assembly and the axial slide assembly.

Also disclosed herein is a tenon peening method including: positioning a portable automated peening device relative to a turbine wheel; securing the portable automated penning device; measuring a distance from a peening machine to a tenon; positioning a peening machine to peen the tenon with a circumferential slide assembly and an axial slide assembly; and peening said tenon with said peening machine.

Other systems, methods, and/or computer program products according to exemplary embodiments will be or become apparent to one with skill in the art upon review of the following drawings and detailed description. It is intended that all such additional systems, methods, and/or computer program products be included within this description, be within the scope of the present disclosure, and be protected by the accompanying claims.

BRIEF DESCRIPTION OF THE DRAWINGS

These and other features, aspects, and advantages of the present invention will become better understood when the following detailed description is read with reference to the accompanying figures, wherein.

DETAILED DESCRIPTION

Figure 1:
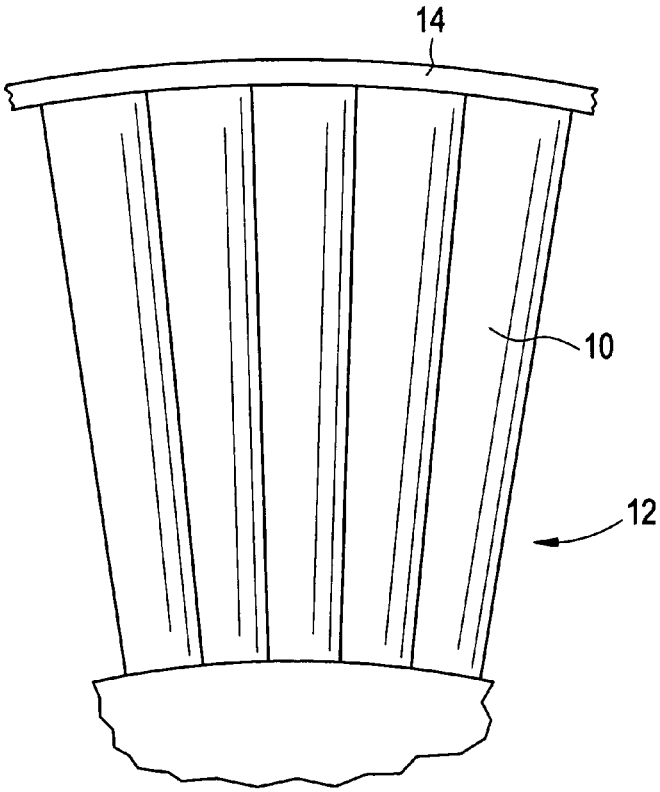
FIG. 1 PRIOR ART
FIG. 1 is a fragmentary axial view illustrating a plurality of buckets with an attached cover.
Figure 2:
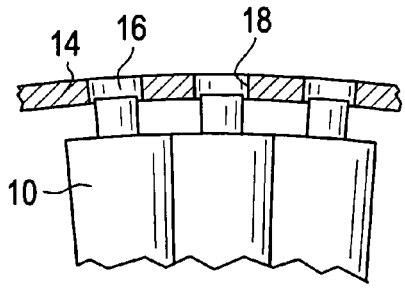
FIG. 2 PRIOR ART
FIG. 2 is a fragmentary enlarged view illustrating the tenons and openings through the cover prior to assembly.
Figure 3:
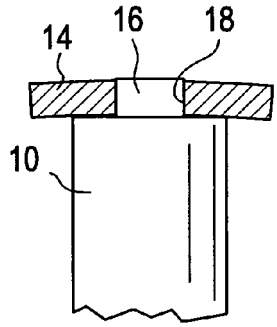
FIG. 3 PRIOR ART
FIG. 3 is a fragmentary cross-sectional view illustrating a flush tenon cover/bucket connection.

Referring now to FIG. 1, there is illustrated a plurality of buckets 10 forming part of a rotating component of a turbine, generally indicated 12, of a steam turbine. Covers 14 are secured to outer tips of the buckets, the covers extending in a circumferential direction. As illustrated in FIGS. 2 and 3, the tips of the buckets 10 have one or more tenons 16 projecting radially outwardly of the tips. Each cover 14 is typically provided in an arcuate circumferentially extending segment for spanning a plurality of buckets, for example, four or five buckets, and has openings 18 for receiving the tenons. The tenons are received in the openings 18 and peened to form a flush cover design, as illustrated in FIG. 3.

Figure 4:
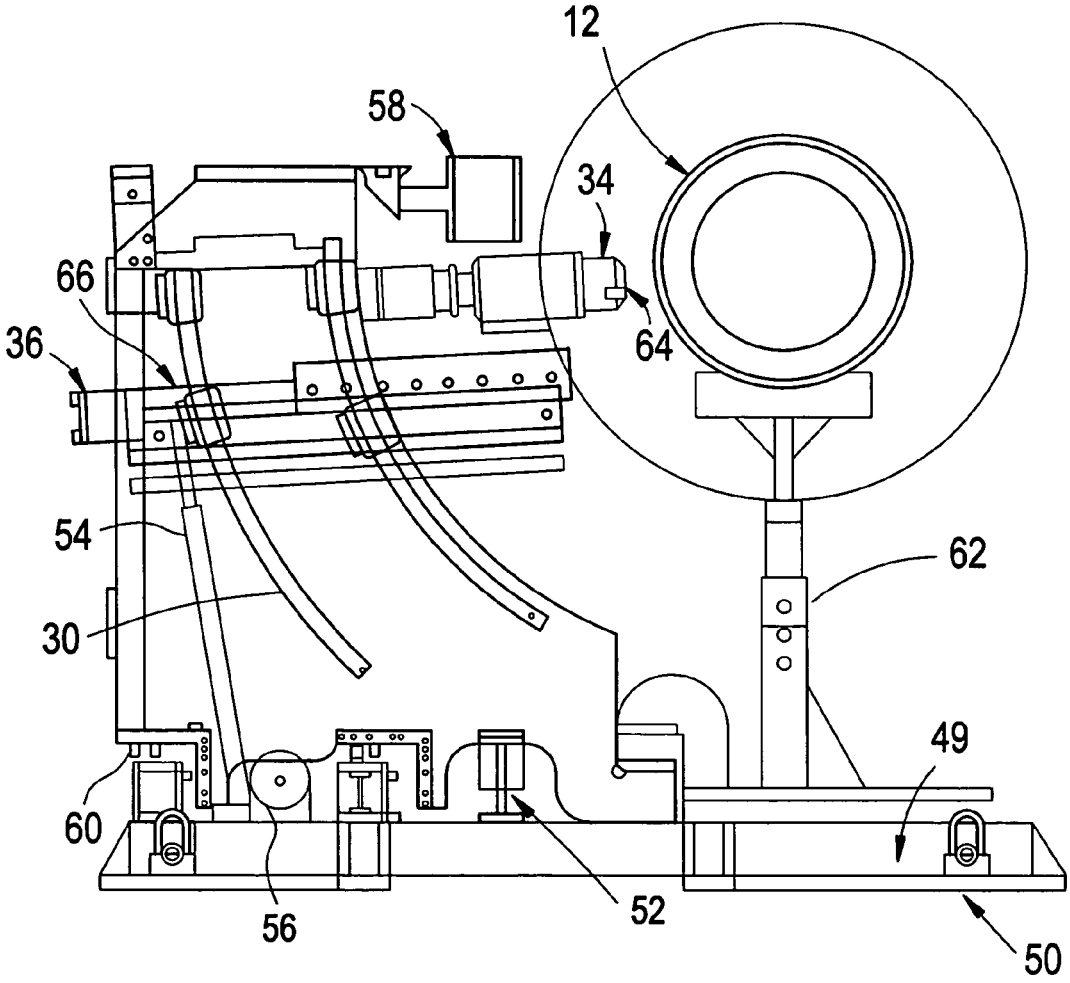
FIG. 4 is a schematic view of an exemplary embodiment of a portable automated peening device.

Turning now to FIG. 4, an exemplary embodiment of a portable automated peening device is depicted generally as 32. The portable automated peening device 32 includes a peening machine 34, which is in operable communication with a mounting arm 36. The mounting arm 36 includes a radial slide assembly 66, the radial slide assembly includes, but is not limited to a, a wheel, a gear, any other suitable device. The mounting arm is slidably disposed upon a circumferential slide assembly 40. The peening machine 34 may be slidably mounted to the mounting arm 36 such that the position of the peening machine 34 may be adjusted with respect to the mounting arm 36. The circumferential slide assembly 40 is slidably disposed upon an axial slide assembly 44. The circumferential slide assembly 40 and the axial slide assembly 44 are used to properly position the peening machine 34 to peen the tenons 16 (FIG. 2) to the bucket tips. The movements of the peening machine 34, the circumferential slide assembly 40, and the axial slide assembly 44 are controlled by a programmable logic controller (not shown).

Figure 5:
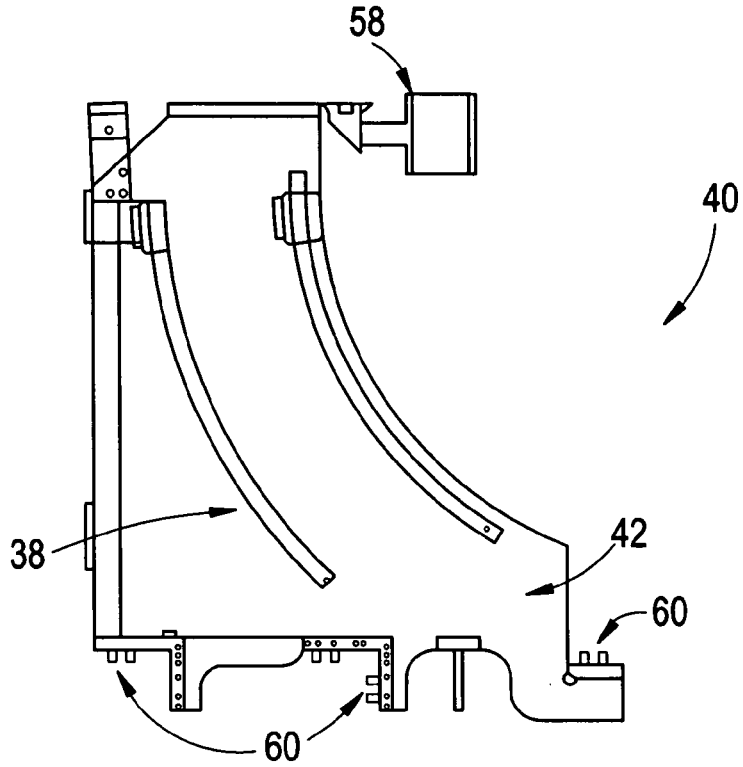
FIG. 5 is a schematic view of an exemplary embodiment of a circumferential slide assembly.

Continuing now with reference to FIG. 5, an exemplary embodiment of the circumferential slide assembly is depicted generally as 40. The circumferential slide assembly includes a circumferential rail 38, which is mounted to a circumferential slide body 42. The circumferential slide body 42 may be constructed of any material suitable to support the weight of the mounting arm 36 and the peening machine 34 and also the force exerted by the peening machine 34. Additionally, one side of the circumferential slide body 42 has a generally curved shape with an arc similar to that of the circumferential slide rail 38.

The mounting arm 36 may be moved along the circumferential rail 38 by a first actuator 54. The first actuator 54 may be, but is not limited to, a hydraulic actuator, an electric actuator, or a pneumatic actuator. A programmable logic controller (not shown) may control the first actuator 54. The circumferential slide assembly 40 also includes an operator-swinging pendant 58, which includes the control interface for the operator to use the portable automated peening device 32. The circumferential slide assembly 40 further includes a second slide device 60 disposed on the circumferential slide body 42, the second slide device includes, but is not limited to a, a wheel, a gear, any other suitable device.

Figure 6:
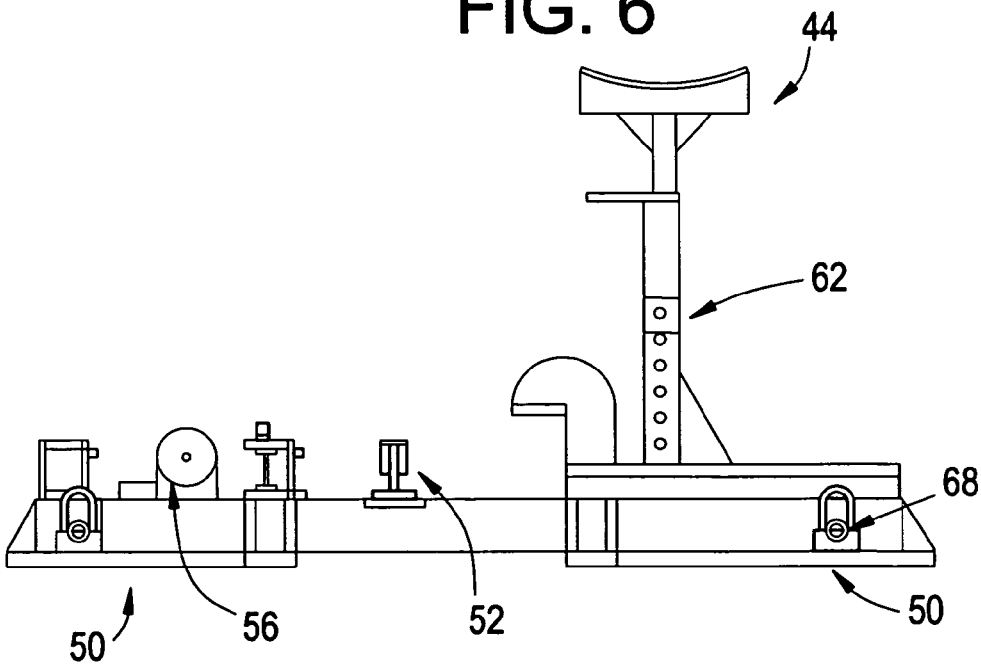
FIG. 6 is a schematic view of an exemplary embodiment of a axial slide assembly.

Referring now to FIG. 6, an exemplary embodiment of the axial slide assembly is depicted generally as 44. The axial slide assembly 44 includes an axial rail 46, a vertical support 50, a clamp 52, and an axial slide body 68. The circumferential slide assembly 40 (FIG. 4) is moved along the axial rails 46 by a second actuator 56. In another exemplary embodiment, the axial slide assembly 44 may include a plurality of axial rails 46. The second actuator 56 may be, but is not limited to, a hydraulic actuator, an electric actuator, or a pneumatic actuator. The programmable logic controller may control the movement of the second actuator 56. In alternative exemplary embodiments, a user may move the circumferential slide assembly 40 along the axial rails 46 manually.

Continuing with reference to FIG. 6, the vertical support 50 is disposed on the opposite side of the axial slide body 68 from the axial rail 46 and the vertical support is designed to allow a user to move the portable automated peening device 32 without the use of additional equipment, such as an overhead crane system. In an exemplary embodiment the vertical support 50 may be an air caster. Additionally, the clamp 52, which is disposed on the axial slide body 68, allows the portable automated peening device 32 to be securely positioned before the peening machine 34 (FIG. 4) is activated. The axial slide assembly 44 further includes a support member 62, which is designed to support the turbine rotor 10 during peening. The support member 62 may be of a fixed height or in an alternative exemplary embodiment the height of the support member 62 may be adjustable. Additionally, the support member 62 may be slidably disposed upon the axial slide body 68 such that the position of the support member 62 may be adjusted.

Returning now to FIG. 4, in an exemplary embodiment the automated peening device 32 includes a distance finder 64 that is capable of accurately measuring the distance to the tenon to be peened. The distance finder 64 may be affixed to the peening machine 34 or to the mounting arm 36. In an exemplary embodiment, the distance finder 64 is a laser distance finder. The laser distance finder 64 communicates the measured distance to the programmable logic controller, which responsively controls the position of the peening machine 34 by controlling the first actuator 54 and the second actuator 56. It is contemplated that the circumferential slide assembly 40 can be designed to provide for a wide range of circumferential movement. Likewise, the axial slide assembly 44 can be designed to provide for a wide range of axial movement depending upon the size of the axial slide body 68. In exemplary embodiments, the mounting arm 36 may include a radial positioning table that allows for angular adjustment of the peening machine 34 relative to the orientation of the tenons. The radial positioning table facilitates the peening of angled tenons.

Figure 7:
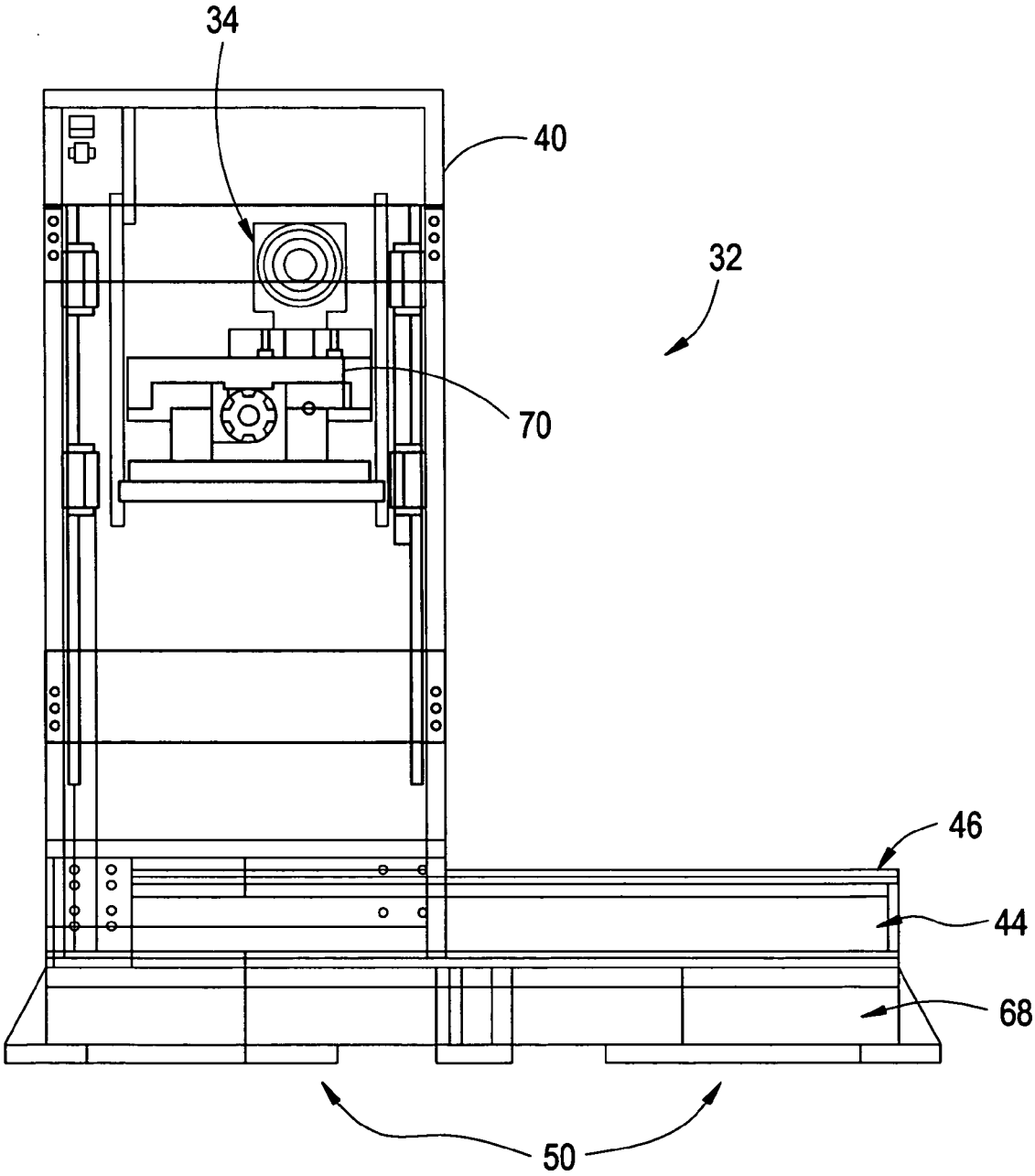
FIG. 7 is an alternate schematic view of the portable automated peening device shown in FIG. 4.

Turning now to FIG. 7, an alternate schematic view of the portable automated peening device 32 is depicted. As illustrated, the circumferential slide assembly 40 is slidably disposed upon the axial rail 46, which is affixed to the axial slide body 68. The axial slide assembly 44 includes the vertical support 50 disposed on the opposite side of the axial slide body 68 from the axial rail 46. The vertical support 50 is used to properly position the automated peening device 32 for peening of the turbine 12. After the automated peening device 32 is properly positioned it is secured using the clamp 52 (FIG. 6). The clamp 52 is disposed on the axial slide body 68. The axial slide assembly 44 and the circumferential slide assembly 40 are used to properly position the peening machine 34 for peening. In exemplary embodiments, the peening machine 34 is affixed to a second axial slide assembly 70, which is also affixed to the mounting arm 36. The second axial slide assembly 70 allows for adjustment of the peening machine in the axial direction with respect to the turbine 12.

In another exemplary embodiment, the programmable logic controller, which controls the movements of the first actuator 54 and the second actuator 56 and thereby the position of the peening machine 34, includes a safety function. The safety function is designed to ensure that the portable automated peening device 32 is secured before the peening machine 34 is used. The programmable logic control may sense the state to the clamp 52 to determine if the portable automated peening device 32 is properly secured.

In exemplary embodiments the portable automated peening device 32 is operable to sweep multiple locations, in other words the portable automated peening device 32 can slide along the linear axis of the turbine 12, and peen several rows of tenons 16 without moving the portable automated peening device 32. Additionally, the portable automated peening device 32 can peen several tenons 16 radially while the portable automated peening device 32 remains stationary. It is also contemplated that the portable automated peening device 32 may be indexed around the turbine 12, in the case that the turbine 12 is mounted on a lathe. However, the portable automated peening device 32 is designed to be portable and is intended to be shipped to various locations.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A self indexing portable automated peening device comprising:

a peening machine in operable communication with a mounting arm;

a circumferential slide assembly comprising a circumferential rail in operable communication with said mounting arm;

an axial slide assembly comprising axial slide rail in operable communication with said circumferential slide assembly;

a base in operable communication with said axial slide assembly;

a distance finder in operable communication with said peening machine; and a programmable logic controller for controlling a position of said circumferential slide assembly and said axial slide assembly.

2. The device of claim 1 comprising a radial positioning table in operable communication with said mounting arm and said peening machine wherein said radial positioning table facilitates peening at a variety of angles.

3. The device of claim 1 wherein said distance finder is a laser distance finder.

4. The device of claim 1 wherein said base comprises a vertical support for positioning of said base and a clamp for securing said base for operation of said peening machine.

5. The device of claim 1 comprising a first actuator in operable communication with said circumferential slide assembly and said axial slide assembly wherein said programmable logic controller controls said first actuator.

6. The device of claim 1 comprising a second actuator in operable communication on with said base and said axial slide assembly wherein said programmable logic controller controls said second actuator.

7. The device of claim 5 comprising a second actuator in operable communication with said base and said axial slide assembly wherein said programmable logic controller controls said actuator.

8. The device of claim 4 wherein said programmable logic controller prevents the use of said peening machine when said clamp is not engaged.

9. The device of claim 3 wherein said programmable logic controller controls said position of said circumferential slide assembly and said axial slide assembly responsive to said laser distance finder.

10. The device of claim 1 wherein said axial slide assembly comprises a plurality of axial slide rails in operable communication with said circumferential slide assembly.

11. A tenon peening method comprising:

positioning a portable automated peening device relative to a turbine wheel;

securing the portable automated penning device;

measuring a distance from a peening machine to a tenon;

positioning a peening machine to peen the tenon with a circumferential slide assembly and an axial slide assembly; and peening said tenon with said peening machine.

12. The method of claim 11 wherein said positioning of peening machine is responsive to said distance from said peening machine to said tenon.

13. The method of claim 11 wherein a vertical support is used for said positioning a portable automated peening device relative to a turbine wheel.

14. The method of claim 11 wherein a clamp is used for said securing the portable automated peening device.

15. A portable system for tenon peening comprising:

means for positioning a portable automated peening device relative to a turbine wheel;

means for securing the portable automated penning device;

means for measuring a distance from a peening machine to a tenon;

means for positioning a peening machine to peen the tenon with a circumferential slide assembly and an axial slide assembly; and means for peening said tenon with said peening machine.

* * * * *